US005267524A

United States Patent [19]

Maxwell

[11] Patent Number: 5,267,524

[45] Date of Patent: Dec. 7, 1993

[54] ROTATING NON-FOWLING FLAG AND FLAG BRACKET

[76] Inventor: John S. Maxwell, 24382 Fairway La., Coto de Casa, Calif.

[21] Appl. No.: 989,813

[22] Filed: Dec. 10, 1992

[51] Int. Cl.[5] ..... G09F 17/00

[52] U.S. Cl. ..... 116/174; 116/173; 248/532

[58] Field of Search ..... 116/173, 174; 248/532, 248/538, 520; 40/604

[56] References Cited

U.S. PATENT DOCUMENTS

| | | | |
|---|---|---|---|
| 1,195,224 | 8/1916 | Hoffman | 116/174 |
| 1,476,426 | 12/1923 | Short | 116/174 |
| 2,848,117 | 8/1958 | Miller | 248/538 X |
| 4,123,813 | 11/1978 | Adams | 116/173 X |
| 4,375,134 | 3/1983 | Sheetz | 116/173 X |

*Primary Examiner*—Daniel M. Yasich
*Attorney, Agent, or Firm*—Stetina and Brunda

[57] ABSTRACT

A flag assembly has a flag or planar member and a bracket having a first member to which the planar member is attached for supporting the planar member and also having a second member extending downwardly therefrom such that the second member is insertible into a bore formed in a post such that the weight of the first elongate member combined with the weight of the flag causes the lower-most end of the second member to frictionally engage the bore of the post to prevent the bracket from being inadvertently removed therefrom. Such construction allows the flag to freely rotate with the wind and thereby mitigates the incidence of fowling. The first member maintains the planar member in an extended configuration suitable for viewing.

15 Claims, 1 Drawing Sheet

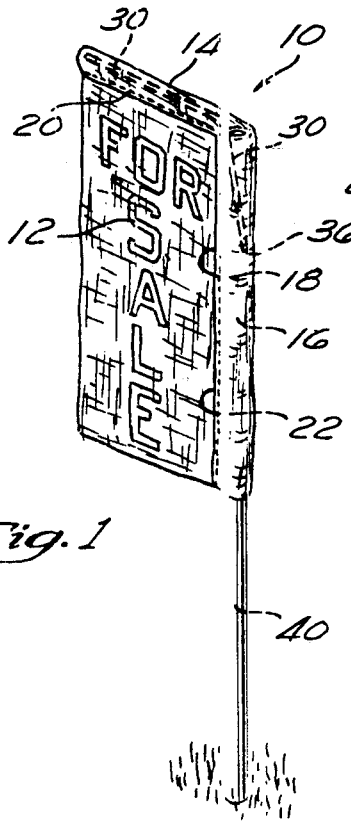
Fig. 1
Fig. 2
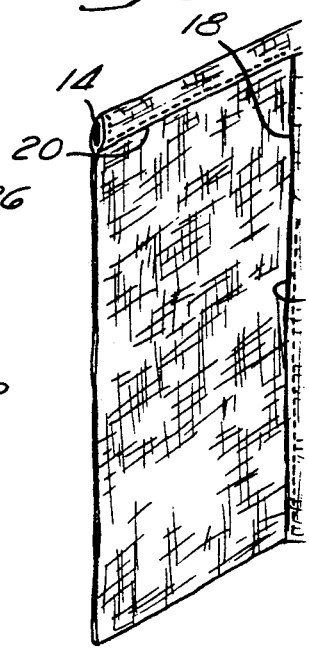
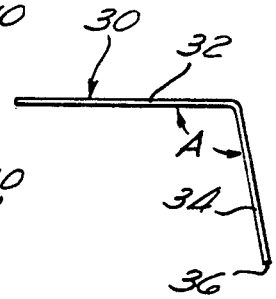
Fig. 3
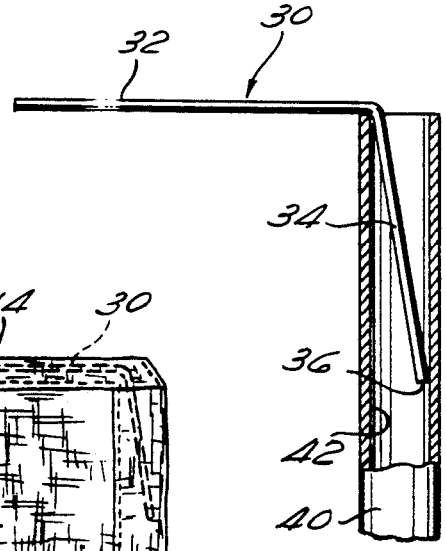
Fig. 6
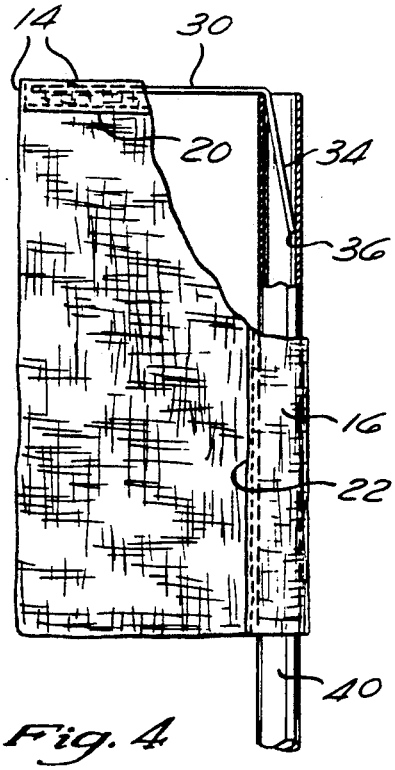
Fig. 4
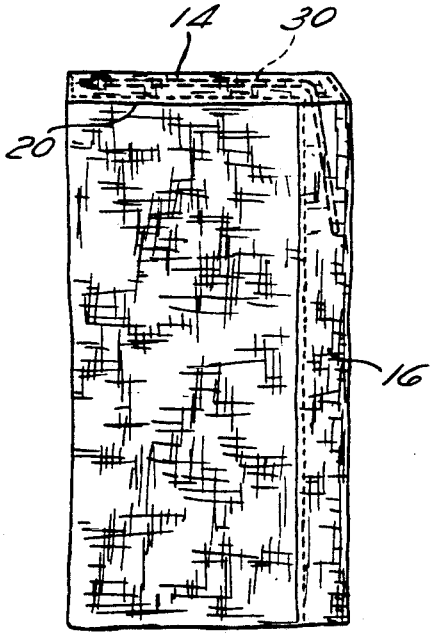
Fig. 5

ROTATING NON-FOWLING FLAG AND FLAG BRACKET

FIELD OF THE INVENTION

The present invention relates generally to display devices and more particularly to a flag which rotates with the wind to prevent fowling thereof and which is easily and conveniently replaceable.

BACKGROUND OF THE INVENTION

Flags used in celebrations and promotional activities are well known. One common type of such flags utilizes a post driven into the ground or fixedly attached to an architectural structure or the like. The post has a bore into which a support member or bracket attached to the flag is insertible. The bracket is generally configured as an elongate straight member attached along one side the flag in the fashion of a shortened flagpole.

Such construction facilitates easy mounting and removal of the flag. The flag is mounted for display by simply inserting the bracket thereof into the bore of the post. The flag is removed from display simply by removing the bracket from the bore of the post.

The ability to easily mount and remove the flag is particularly important in promotional applications wherein indicia formed upon the flag are subject to frequent change. The ability to easily mount and remove such flags is also important in those instances where such flags are subject to environmental elements, i.e. wind, rain, dust, etc., which hasten deterioration of the flag, thereby requiring its more frequent replacement.

However, a problem inherently associated with such mounting is the adequate anchoring of the flag and bracket to the post. Generally, the bracket is merely inserted into a bore formed in the post such that the flag may rotate with the wind, thus preventing fowling thereof. It is important to prevent fowling of the flag such that the flag may readily extend to its full length, thereby adequately and properly displaying the indicia formed thereon. However, such rotatable mounting commonly allows the wind to force the flag and bracket from its intended mount upon the post. As such, the wind commonly blows the flag with sufficient force to cause the bracket to ride up out of the bore of the post such that the flag is undesirably detached therefrom.

Prior art attempts to secure the flag to the post have involved taping or tying the bracket thereto. However, such prior art attempts suffer from the inherent deficiencies that they are both time consuming, and consequently expensive to practice, and that they lead to fowling of the flag. Such procedures are comparatively time consuming because they not only require that the bracket be inserted into the bore of the post, but also that a desired length of tape or string be supplied and manually attached to both the bracket and the post in a manner adequate for securely attaching the two together. Such use of string or tape thus greatly increases the time required to mount the flag.

Furthermore, removal of the flag is made much more difficult, and consequently more expensive, since the tape or string must be cut or detached from the post. This typically requires the use of tools, i.e., scissors, knives, etc., and commonly results in remnants of the string or tape remaining attached to the post, thereby undesirably affecting the aesthetic quality of a newly inserted flag.

The likelihood of fowling of a flag so attached to a post is increased since the flag and bracket are prevented from rotating relative to the post by the string or tape interconnecting the two. Thus, as the wind changes direction, the flag tends to wrap about the post in a manner which prevents one from adequately observing the indicia formed thereon.

Prior art attempts to overcome these deficiencies have included the use of bearing assemblies which allow the flag to rotate with the wind and which include an anchoring means for preventing the inadvertent detachment of the flag from the post. However, such bearing assemblies and anchoring means are comparatively complex and thus expensive.

In view of the shortcomings of the prior art, it is desirable to provide an inexpensive means whereby a flag can be quickly and conveniently attached to a post in a manner which is secure and which does not increase the probability of fowling of the flag.

SUMMARY OF THE INVENTION

The present invention specifically addresses and alleviates the above-mentioned deficiencies associated with the prior art. More particularly, the present invention comprises a flag assembly having a flag or planar member and a bracket having a first elongate member to which the planar member is attached for supporting the planar member and also having a second elongate member extending downwardly therefrom such that the second elongate member is insertible into a bore formed in a post. The weight of the first elongate member combined with the weight of the flag cause the lower-most end of the second elongate member to frictionally engage the bore of the post so as to prevent the bracket from being inadvertently removed therefrom. Such construction allows the flag to freely rotate with the wind and thereby mitigates the incidence of fowling. The first elongate member maintains the planar member in an extended configuration suitable for viewing.

More particularly, the bracket comprises a generally horizontal first elongate member and a second elongate member extending downwardly from the first elongate member. The first elongate member and the second elongate member form an angle of greater than approximately 90 degrees and less than approximately 145 degrees, preferably approximately 100 degrees. The first and second elongate members are preferably integrally formed of a metal, i.e. steel, aluminum, or a similar structural metal, preferably by bending an originally straight member. However, those skilled in the art will recognize that the bracket may likewise be formed of various other materials, i.e. wood, plastic, etc. and by various other processes. The first and second elongate members of the bracket preferably have a diameter between approximately $\frac{1}{8}$ and $\frac{1}{2}$ inch, preferably approximately $\frac{1}{4}$ inch. Those skilled in the art will recognize that the diameter of the first and second elongate members must be suitable for bearing the weight of the flag.

The flag comprises a planar member upon which indicia are formed. A first sleeve is formed along the top of the planar member and a second sleeve is formed along one side of the planar member such that the first and second sleeves define a common passageway. An opening is formed in at least one of the first and second sleeves, preferably the second sleeve proximate the interface of the first and second sleeves, such that the bracket is insertible therethrough.

The planar member preferably comprises a flexible fabric or material. Those skilled in the art will recognize that various other materials, i.e. paperboard, cardboard, metal, etc., are likewise suitable.

The first and second sleeves are preferably formed by sewing the flexible fabric. However, those skilled in the art will recognize that various other means are suitable for attachment of various other flag materials to the bracket. The bracket is disposed within the first and second sleeves for maintaining the flag in a flying or extended configuration suitable for viewing and for attaching the flag to a post. The flag is typically attached to a post having a bore formed therein by simply inserting the second elongate member of the flag assembly into the bore of the post. Thus, the flag and bracket assembly are free to rotate, typically as driven by the wind, relative to the post and fowling is thereby mitigated.

Inadvertent removal of the flag assembly from the post is made less probable by the unique construction of the present invention. This occurs because the weight of the flag and first elongate member, in combination, cause the lower-most end of the second elongate member to frictionally engage or push against the bore of the post, thus increasing the force required for removal therefrom. That is, the cantilevered nature of the flag and first elongate post lever the lower-most end of the second elongate member against the inner surface of the post such that increased force is required to pull the second elongate member upward through the bore thereof. This greatly reduces the likelihood of the wind blowing the flag away from the post. This effect can be further enhanced by attaching weights to the flag and/or first elongate member, preferably to the flag along the lower surface thereof.

By eliminating the requirement for string or tape, installation and removal of the flag is greatly simplified and fowling of the flag is mitigated.

These, as well as other, advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 1 is a perspective view of the rotating non-fowling flag and flag bracket of the present invention installed upon a post which extends upwardly from the ground;

FIG. 2 is a perspective view of the flexible fabric or flag portion of the present invention;

FIG. 3 is a side view of the bracket of the present invention;

FIG. 4 is an enlarged sectional view of the flag assembly of FIG. 1;

FIG. 5 is a side view of the flag and bracket of the present invention prior to installation upon a post; and FIG. 6 is a side view, partially in cross-section, illustrating engagement of the bracket with the bore of the post.

DETAILED DESCRIPTION OF THE PREFERRED EMBODIMENT

The detailed description set forth below in connection with the appended drawings is intended as a description of the presently preferred form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The rotating non-fowling flag and flag bracket of the present invention are illustrated in FIGS. 1–6 of the drawings which depict a presently preferred embodiment of the invention. Referring now to FIGS. 1–6, the present invention generally comprises a planar member or flag 10 preferably formed of a flexible fabric or material and typically having indicia 12 formed thereupon. A first sleeve 14 is formed along the top of the planar member 10 and a second sleeve 16 is formed along one side of the planar member. The first 14 and second 16 sleeves define a common passageway. An opening 18 is formed in at least one of the first and second sleeves such that a bracket is insertible therethrough. The opening 18 is preferably formed in the second sleeve near the interface of the first 14 and second 16 sleeves.

The first 14 and second 16 sleeves are preferably formed by folding over the edge portions of the planar member 10 and sewing the edge portions in place such that sleeves 14 and 16 are formed thereby. Thus, a first seam 20 is formed along the upper edge of the planar member 10 to define the first sleeve 14 and a second seam 22 is formed along the side of the planar member to define the second sleeve 16.

A bracket 30 is disposed within the first 14 and second 16 sleeves. The bracket 30 comprises a generally horizontal first elongate member 32 and a second elongate member 34 extending downwardly from the first elongate member 32 such that an angle A (as shown in FIG. 3) greater than approximately 90 degrees is formed therebetween.

The first elongate member 32 is configured to support the flag or planar member 10 therefrom and the second elongate member 34 is configured to be received within a vertical post 40 having a bore 42 formed therein such that the weight of the first elongate member 32 and the weight of the planar member 10 cause the lower-most end 36 of the second elongate member 34 to frictionally engage the bore 42 to prevent the bracket 30 from being inadvertently removed from the bore 42 of the post 40.

With particular reference to FIGS. 4 and 6, it can be appreciated that the combined weight of the planar member 10 and the first elongate member 32 are cantilevered from the post 40 such that the lower-most end 36 of the second elongate member 34 is urged into abutting frictional contact with the inner surface or bore 42 of post 40. As such, withdrawal of the second elongate member 34 from the post 40 is inhibited by such frictional contact. Thus, the probability of having the wind lift the second elongate member 34 from the post 40 is substantially mitigated. As such, the force of the wind must be sufficient to overcome the frictional force between the lower-most end 36 of the second elongate member 34 and the bore 42.

The friction between the lower-most portion 36 of the second elongate member 34 and the bore 42 of the post 40 can be enhanced by applying additional weight to the first elongate member 32 and/or the planar member 10, preferably along the lower edge of the planar member 10 so as to maintain adequate extension thereof for proper display of the indicia 12 formed upon the planar member 10.

The planar member and the bracket 30 are free to rotate about the post 40 as the second elongate member 34 of the bracket 30 pivots within the bore 42 of the post 40.

As can be appreciated, installation of the flag assembly, defined by the planar member 10 and the bracket 30, upon the post 40 is greatly simplified over prior art methods wherein the flag must be securely attached to the post 40 via string, tape, etc. To practice the present invention, the second sleeve 16 is merely inserted over the post 40 such that the second elongate member 34 of the bracket 30 is received within the bore 42 of the post 40.

To remove the flag assembly of the present invention from the post 40, it is merely necessary to lift the flag assembly upwards, thus withdrawing the second elongate member 34 from the bore 42 of the post 40. Slight angling of the first elongate member 32 of the bracket 30 upwardly disengages the lower-most end 36 of the second elongate member 34 from the bore 42 of the post 40 such that they are no longer frictionally engaged, thus easing withdrawal of the second elongate member 34 from the bore 42.

By making installation and removal of the flag assembly comparatively easy, the user may readily change the indicia 12 as desired, i.e. by replacing the flag. Additionally, the planar member 10 is easily changed as it becomes worn due to environmental effects, i.e. wind, rain, dust, etc. Thus, more frequent changing of the flag is facilitated.

The flag or planar member 10 may be provided or sold separately from the bracket 30, since it is the planar member 10 which is typically subject to wear or which requires change due to a desire for different indicia 12. The user simply removes the original bracket 30 from an old flag assembly by manipulating it through the opening 18. By reversing the process, i.e. inserting the original bracket 30 into the opening 18 of a new planar member 10, the new planar member 10 is readied for display.

It can be appreciated that the bracket 30 is easily insertible into the opening 18 such that the first elongate member 32 thereof is disposed within the first sleeve 14 and the second elongate member 34 thereof is disposed within the second sleeve 16. This is most easily accomplished by first inserting the first elongate member 32 into the first sleeve 34 through the opening 18 up to the intersection of the first 32 and second 34 elongate members and then merely passing the second elongate member 34 through the opening 18 such that it is disposed within the second sleeve 16.

It is understood that the exemplary rotating nonfowling flag and flag bracket of the present invention described herein and shown in the drawings represents only a presently preferred embodiment of the invention. Indeed, various modifications and additions may be made to such embodiment without departing from the spirit and scope of the invention. For example, the planar member may be of various shapes, i.e. triangular, hexagonal, etc., as desired. Also, the bracket may be configured of any desired cross-section, i.e. round, square, hexagonal, etc. Thus, these and other modifications and additions may be obvious to those skilled in the art and may be implemented to adapt the present invention for use in a variety of different applications.

What is claimed is:

1. A bracket for displaying a flag, said bracket comprising:

a) a generally horizontal first elongate member;

b) a second elongate member extending downwardly from said first elongate member such that an angle is formed therebetween; and c) said first elongate member being configured to support a flag therefrom and said second elongate member being configured to be received within a generally vertical post having a bore such that the weight of the first elongate member and the weight of the flag cause the lower-most end of the second elongate member to frictionally engage the bore to prevent the bracket from being inadvertently removed therefrom.

2. The bracket as recited in claim 1 wherein said first elongate member and said second elongate member form an angle of less than approximately 145 degrees.

3. The bracket as recited in claim 1 wherein said first elongate member and said second elongate member form an angle of approximately 100 degrees.

4. The bracket as recited in claim 1 wherein said first and second elongate members are integrally formed of metal.

5. The bracket as recited in claim 1 wherein said first and second elongate members have a diameter between approximately $\frac{1}{8}$ and $\frac{1}{2}$ inch.

6. The bracket as recited in claim 1 wherein said first and second elongate members have a diameter of approximately $\frac{1}{4}$ inch.

7. A flag comprising:

a) a planar member upon which indicia are formable;

b) a first sleeve formed along the top of said planar member;

c) a second sleeve formed along one side of said planar member, said first and second sleeve defining a common passageway;

d) an opening formed in at least one of said first and second sleeves such that a bracket is insertible therethrough, and e) the bracket disposed within said first and second sleeves for maintaining said flag in a flying configuration and for mounting said flag to an opening in a post.

8. The flag as recited in claim 7 wherein said opening is formed in said second sleeve.

9. The flag as recited in claim 7 wherein said planar member comprises fabric.

10. The flag as recited in claim 7 wherein said planar member comprises paperboard.

11. The flag as recited in claim 7 wherein said first and second sleeves are formed by sewing.

12. A method of displaying a flag, said method comprising:

a) attaching a generally horizontal first member of a bracket to a flag such that the flag is supported thereby, the bracket having a downwardly extending second member formed of an angle greater than approximately 90 degrees to the first member thereof; and b) inserting the downwardly extending second member into a bore formed in a vertical post such that the weight of the first elongate member and the weight of the flag cause the lower-most end of the second elongate member to frictionally engage the bore to prevent the bracket from being inadvertently removed therefrom.

13. A flag assembly comprising:

a) a flag comprising:
(i) a planar member upon which indicia are formable;
(ii) a first sleeve formed along the top of said planar member;
(iii) a second sleeve formed along one side of said planar member, said first and second sleeve defining a common passageway; and
(iv) an opening formed in at least one of said first and second sleeves;

b) a bracket disposed within said first and second sleeves for maintaining said flag in a flying configuration, said bracket comprising:
(i) a generally horizontal first elongate member;
(ii) a second elongate member extending downwardly from said first elongate member such that an angle greater than approximately ninety degrees is formed therebetween; and
(iii) said first elongate member being configured to support a flag therefrom and said second elongate member being configured to be received within a vertical post having a bore such that the weight of the first elongate member and the weight of the flag cause the lower-most end of the second elongate member to frictionally engage the bore to prevent the bracket from being inadvertently removed therefrom; and c) a post having a bore into which the second elongate member of said sleeve is received, the weight of said first elongate member and the weight of the flag causing the lower-most end of the second elongate member to frictionally engage the bore to prevent the bracket from being inadvertently removed therefrom.

14. A flag assembly comprising:

a) a planar member;

b) a bracket having a first member to which said planar member is attached for supporting the planar member and having a second member extending downwardly therefrom such that said second member is insertible into a bore formed in a post such that the weight of the first elongate member and the weight of the flag cause the lower-most end of the second member to frictionally engage the bore to prevent the bracket from being inadvertently removed therefrom; and c) wherein the first member maintains the planar member in an extended configuration suitable for viewing and wherein the bracket and the planar member attached thereto are free to rotate relative to the post such that the incidence of fowling is mitigating.

15. A method of forming a flag, the method comprising the steps of:

a) sewing a first sleeve along the top of a fabric member;

b) sewing a second sleeve along side of the fabric member such that said first and second sleeves define a common passageway and such that an opening is defined within said passageway through which a bracket is insertible;

c) inserting the bracket into the passageway via the opening, the bracket having a generally horizontal first elongate member disposed within said first sleeve and also having a second elongate member extending downwardly from said first elongate member such that an angle greater than approximately 90 degrees is formed between said first and second members; and d) wherein said first elongate member supports the planar fabric member therefrom and said second elongate member is receivable within a vertical post having a bore such that the weight of the first elongate member and the weight of the flag cause the lower-most end of the second elongate member to frictionally engage the bore to prevent the bracket from being inadvertently removed therefrom.

* * * * *